US006250986B1

(12) United States Patent
Sorensen

(10) Patent No.: US 6,250,986 B1
(45) Date of Patent: Jun. 26, 2001

(54) BUILDING ELEMENT FOR SET OF TOY BUILDING BLOCKS

(76) Inventor: Soren Christian Sorensen, P.O. Box 256, North Side, Grand Cayman, Cayman Islands, B.W. I. (KY)

( * ) Notice: Subject to any disclaimer, the term of this patent is extended or adjusted under 35 U.S.C. 154(b) by 0 days.

(21) Appl. No.: 09/246,317

(22) Filed: Feb. 8, 1999

(51) Int. Cl.[7] ..... A63H 33/04; A63H 33/06

(52) U.S. Cl. ..... 446/85; 446/121; 446/127

(58) Field of Search ..... 446/85, 120, 121, 446/124, 125, 127, 128

(56) References Cited

U.S. PATENT DOCUMENTS

| | | | | |
|---|---|---|---|---|
| D. 249,232 | * | 9/1978 | Van Der Veken | D9/167 |
| D. 254,752 | | 4/1980 | Gabriel . | |
| D. 278,142 | | 3/1985 | Hill . | |
| D. 363,647 | | 10/1995 | Rivlin et al. . | |
| D. 367,403 | | 2/1996 | Rivlin et al. . | |
| 2,565,823 | * | 8/1951 | Pool | 446/125 |
| 3,205,611 | | 9/1965 | Onanian . | |
| 3,413,752 | * | 12/1968 | Perry | 446/125 |
| 3,415,007 | | 12/1968 | Howe . | |
| 3,479,763 | * | 11/1969 | Fischer | 446/127 |
| 3,545,122 | | 12/1970 | Onanian . | |
| 3,611,609 | | 10/1971 | Reijhnard . | |
| 3,648,404 | | 3/1972 | Ogsbury et al. . | |
| 3,745,736 | | 7/1973 | Fischer . | |
| 4,055,019 | | 10/1977 | Harvey . | |
| 4,129,975 | | 12/1978 | Gabriel . | |
| 4,147,007 | | 4/1979 | Eppich . | |
| 4,160,337 | * | 7/1979 | Fischer | 446/127 |
| 4,435,031 | | 3/1984 | Black et al. . | |
| 4,551,110 | | 11/1985 | Selvage et al. . | |
| 4,676,762 | | 6/1987 | Ballard . | |
| 4,823,532 | | 4/1989 | Westerburgen . | |
| 4,895,544 | | 1/1990 | Fischer . | |
| 4,922,978 | | 5/1990 | Schweiwiller . | |
| 5,022,885 | | 6/1991 | Lyman . | |

(List continued on next page.)

FOREIGN PATENT DOCUMENTS

| | | | | |
|---|---|---|---|---|
| 595883 | * | 4/1960 | (CA) | 446/127 |
| 849775 | | 8/1970 | (CA) . | |
| 2105568 | | 8/1972 | (DE) . | |
| 2144703 | * | 3/1973 | (DE) | 446/120 |
| WO 93/04749 | | 3/1993 | (WO) . | |
| WO 98/35735 | | 8/1998 | (WO) . | |

*Primary Examiner*—D. Neal Muir
(74) *Attorney, Agent, or Firm*—Edward W. Callan

(57) ABSTRACT

A building element for a set of toy building blocks that are capable of being interconnected in a releasable engagement includes a box with side walls, a top having one or more projections, and an open bottom providing access to interior surfaces for frictional engagement with the top projection(s). The side walls includes a plurality of grooves having entry openings of a given predominant width and a plurality of tongues having distal portions of a predominant width that is greater than the given predominant width of the groove entry openings for interconnecting in a releasable restraining engagement with grooves in another such building element. The tongues are flexible and split longitudinally into sections so that the tongues can be compressed laterally in order to effect the restraining engagement by frontally pressing the tongues into the grooves. The tongues can also be disengaged from the grooves by sliding the tongues from one end of the grooves. The side walls have a primary surface that includes recesses adjacent the tongue sections so that the tongue sections extend outward from below the primary surface. Adjacent each entry opening the groove is defined by a first side-wall portion that is inclined outward at an entry angle and a second side-wall second portion that is inclined inward at a restraining angle that is less than the entry angle in relation to a virtual broad surface of the side wall so that less force is required to effect engagement than is required to effect disengagement.

12 Claims, 3 Drawing Sheets

U.S. PATENT DOCUMENTS

| | | | | |
|---|---|---|---|---|
| 5,069,647 | * | 12/1991 | Zuviria | 446/127 |
| 5,098,328 | | 3/1992 | Beerens . | |
| 5,120,253 | | 6/1992 | Gelardi . | |
| 5,137,485 | | 8/1992 | Penner . | |
| 5,259,803 | | 11/1993 | Lyman . | |
| 5,267,863 | | 12/1993 | Simmons, Jr. . | |
| 5,307,581 | * | 5/1994 | Kalmykow | 40/611 |
| 5,310,071 | | 5/1994 | Rivlin et al. . | |
| 5,344,143 | | 9/1994 | Yule . | |
| 5,350,331 | | 9/1994 | Glickman . | |
| 5,527,201 | | 6/1996 | Maddock . | |
| 5,599,512 | | 2/1997 | Latulippe et al. . | |
| 5,653,621 | | 8/1997 | Yao . | |
| 5,683,283 | | 11/1997 | Glynn . | |
| 5,795,210 | | 8/1998 | Kushner et al. . | |
| 5,826,394 | | 10/1998 | Barton, Jr. et al. . | |
| 5,827,105 | | 10/1998 | Felgenhauer et al. . | |
| 5,839,938 | | 11/1998 | Manthei et al. . | |
| 5,964,635 | | 11/1999 | Krog . | |

* cited by examiner

FIG. 1A
PRIOR ART
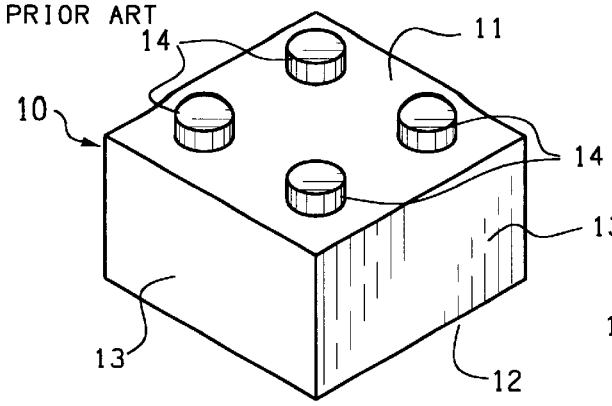
FIG. 1B
PRIOR ART
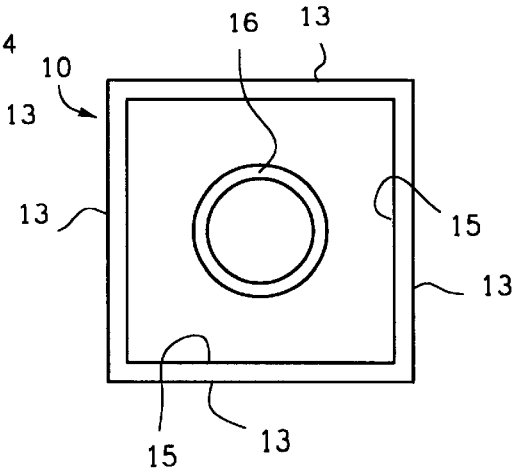
FIG. 2A
PRIOR ART
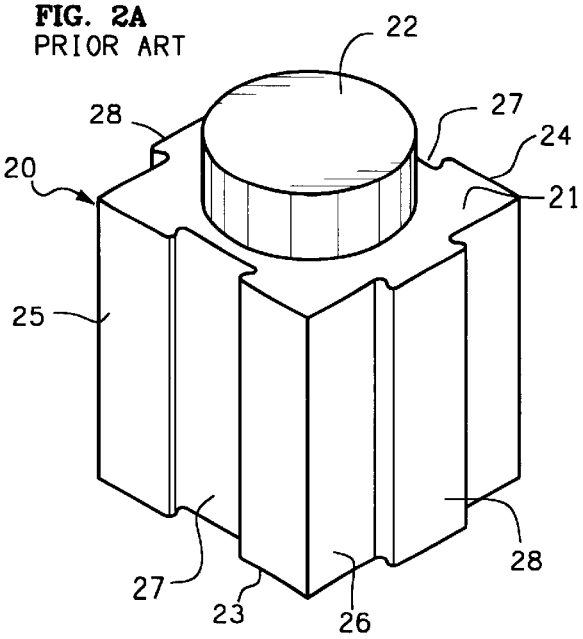
FIG. 2B
PRIOR ART
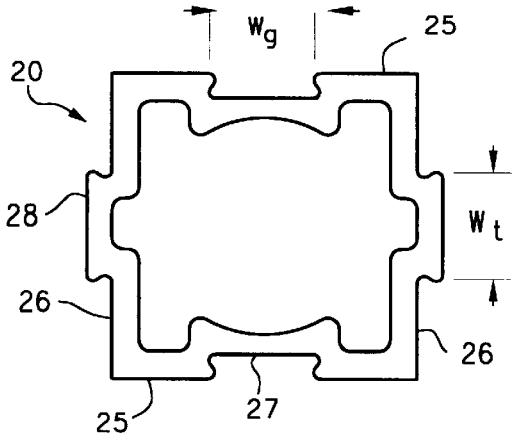
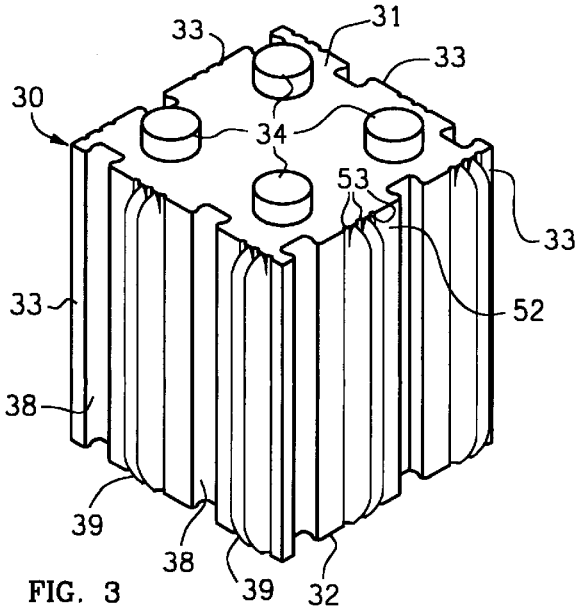
FIG. 3
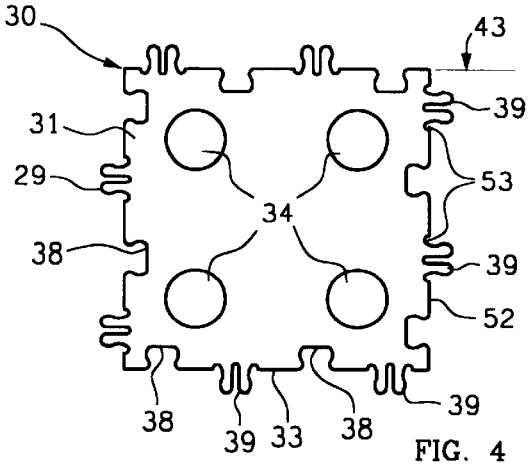
FIG. 4

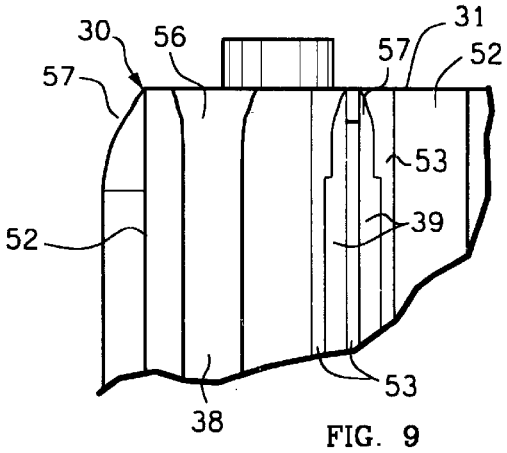
FIG. 9
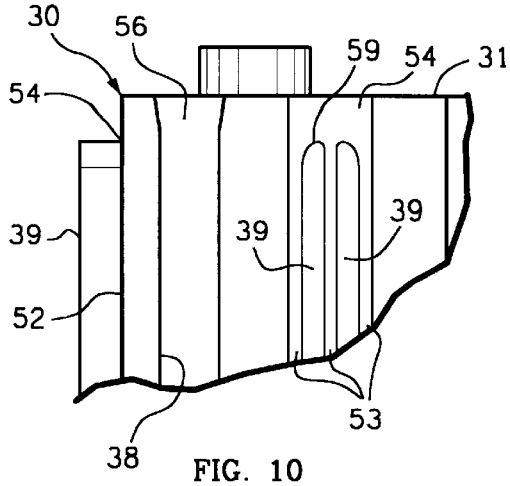
FIG. 10
FIG. 11
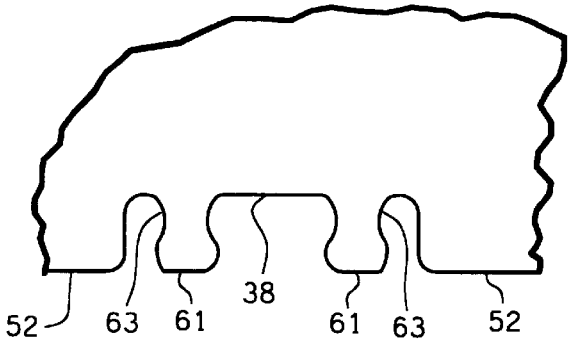
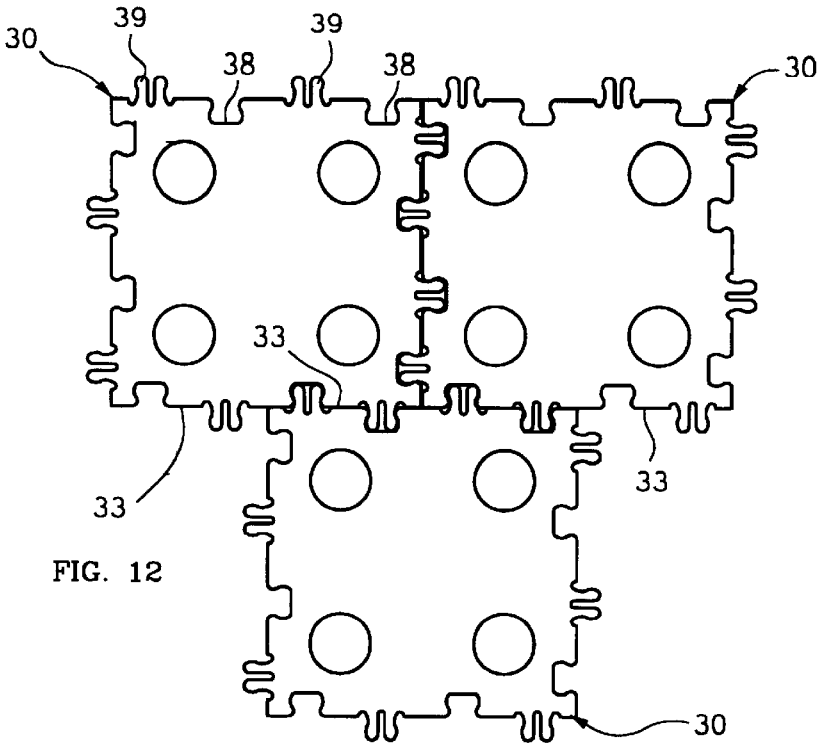
FIG. 12

BUILDING ELEMENT FOR SET OF TOY BUILDING BLOCKS

BACKGROUND OF THE INVENTION

The present invention generally pertains to assembly toys and is particularly directed to an improved building element for a set of toy building blocks.

Referring to FIGS. 1A and 1B, one type of prior art building element for a set of toy building blocks that has been popular for many years comprises a box 10 having a top 11, a bottom 12 and side walls 13, wherein the top 11 of the box 10 includes a two-dimensional array of cylindrical projections 14 and the bottom 12 of the box 10 is open. The interior surfaces 15 of the box 10 and an interior tube 16 are accessible through the bottom 12 of the box 10 for interconnecting with one or more of the projections 14 on the top 11 of another such building element in a releasable frictional engagement. The side walls 13 of this type of building element do not include any means for directly coupling a side wall 13 of the building element to a side wall 13 of another such building element.

Another type of prior art building element for a set of toy building blocks, as shown in FIGS. 2A and 2B, comprises a box 20 having a top 21 including a cylindrical projection 22; a bottom 23 which is open to expose interior surfaces 24 that are accessible for interconnecting with the projection 22 on the top 21 of another such building element in a releasable frictional engagement; and side walls 25, 26 that include means for directly coupling a side wall 25, 26 of the building element to a side wall 26, 25 of another such building element. Each of a pair of side walls 25 on opposite sides of the box 10 include a groove 27 having an entry opening of a given predominant width $w_g$ and the other two side walls 26 include a projection in the shape of a tongue 28 having a distal portion of a predominant width $w_t$ that is greater than the given predominant width $w_g$ of the groove entry opening for interconnecting in a releasable restraining engagement with a groove 27 in another such building element. The tongue 28 can be engaged with and disengaged from the groove 27 in the other such building element by sliding the tongue 28 into or from one end of the groove 27 in the other building element. Also, the building element is made of plastic material having sufficient flexibility that the tongue 28 can be engaged with the groove 27 in the other such building element by frontally pressing the tongue 28 into the groove 27 and can be disengaged therefrom by either twisting or frontally pulling the building element from the other such building element. Based upon experience in interconnecting and disconnecting this type of building element, it seems that at least as much force is required to engage a tongue 28 into a groove 27 when frontally pressing the tongue 28 into the groove 27 as is required to disengage the tongue 28 from the groove 27 by frontally pulling the building element from the other said building element. This type of building element is further described in International Patent Application Publication No. WO 93/04749.

SUMMARY OF THE INVENTION

In one aspect, the present invention provides a building element for a set of toy building blocks that are capable of being interconnected in a releasable engagement, comprising: a box having a top, a bottom and side walls, wherein the top of the box includes a first type of coupling means and the bottom of the box includes a second type of coupling means for interconnecting with the first type of coupling means on another said building element in a releasable frictional engagement; wherein at least one of the side walls includes at least one groove having an entry opening of a given predominant width; wherein at least one of the side walls includes at least one tongue having a distal portion of a predominant width that is greater than the given predominant width of the groove entry opening for interconnecting in a releasable restraining engagement with a said groove in another said building element; and wherein the tongue is flexible and split longitudinally so that the tongue can be compressed laterally in order to effect said restraining engagement by frontally pressing the tongue into a said groove in another said building element.

In another aspect, the present invention provides a building element for a set of toy building blocks that are capable of being interconnected in a releasable engagement, comprising: a box having side walls; wherein at least one of the side walls includes a plurality of projections and a plurality of sockets which are so disposed that said at least one side wall of the building element can be interconnected to said at least one side wall of each of at least two other said building elements with at least two said projection-and-socket engagements between each pair of said interconnected building elements.

In a further aspect, the present invention provides a building element for a set of toy building blocks that are capable of being interconnected in a releasable engagement, comprising: a box having side walls; wherein at least one of the side walls includes at least one socket having an entry opening of a given predominant width; wherein at least one of the side walls includes at least one projection having a distal portion of a predominant width that is greater than the given predominant width of the socket entry opening for interconnecting in a releasable restraining engagement with a said socket in another said building element by frontally pressing the tongue into a said socket in another said building element; wherein the projection and/or the socket is flexible for facilitating said restraining engagement; and wherein less force is required to effect said engagement than is required to disengage the tongue from the socket by frontally pulling the building element from the other said building element.

In yet another aspect, the present invention provides a building element for a set of toy building blocks that are capable of being interconnected in a releasable engagement, comprising: a box having side walls; wherein at least one of the side walls includes at least one socket having an entry opening of a given predominant width; wherein at least one of the side walls includes at least one projection having a distal portion of a predominant width that is greater than the given predominant width of the socket entry opening for interconnecting in a releasable restraining engagement with a said socket in another said building element; wherein a said side wall including the at least one projection has a primary surface that includes recesses adjacent the projection so that the projection extends outward from below the primary surface.

In yet a further aspect, the present invention provides a building element for a set of toy building blocks that are capable of being interconnected in a releasable engagement, comprising: a box having side walls; wherein at least one of the side walls includes at least one groove having an entry opening of a given predominant width; wherein at least one of the side walls includes at least one tongue having a distal portion of a predominant width that is greater than the given predominant width of the groove entry opening for interconnecting in a releasable restraining engagement with a said groove in another said building element; wherein the width of at least one end of the tongue is not greater than said given predominant width of the groove entry opening.

In still another aspect, the present invention provides a building element for a set of toy building blocks that are capable of being interconnected in a releasable engagement, comprising: a box having side walls; wherein at least one of the side walls includes at least one groove having an entry opening of a given predominant width; wherein at least one of the side walls includes at least one tongue having a distal portion of a predominant width that is greater than the given predominant width of the groove entry opening for interconnecting in a releasable restraining engagement with a said groove in another said building element; wherein the width of at least one end of the entry opening of the groove is greater than said given predominant width of the groove entry opening.

Additional features of the present invention are described with reference to the detailed description of the preferred embodiments.

BRIEF DESCRIPTION OF THE DRAWING

FIG. 1A is a perspective view of a first type of prior art building element for a set of toy building blocks.

FIG. 1B is a bottom view of the prior art building element of FIG. 1A.

FIG. 2A is a perspective view of a second type of prior art building element for a set of toy building blocks.

FIG. 2B is a bottom view of the prior art building element of FIG. 2A.

FIG. 3 is top and two-sided perspective view of a preferred embodiment of a building element according to the present invention.

FIG. 4 is a top view of the building element of FIG. 3.

FIG. 9 is a partial side view of the building element of FIG. 3 that is enlarged to better illustrate the relative predominant widths of the tongue and the groove entry opening and the relative widths of the tongue and the groove entry opening near the top of a side wall.

FIG. 10 is a partial side view of an alternative embodiment to the building element of FIG. 3 that is enlarged to better illustrate the relative predominant widths of the tongue and the groove entry opening and the relative widths of the tongue and the groove entry opening near the top of a side wall.

FIG. 11 is an enlarged partial top view of an alternative embodiment to the building element of FIG. 3 illustrating a groove that is defined by flexible partially recessed side walls.

FIG. 12 is a top view illustrating the interconnection of one side wall of one building element according to FIG. 3 with the side wall of two other building elements according to FIG. 3.

DETAILED DESCRIPTION

Figure 5:
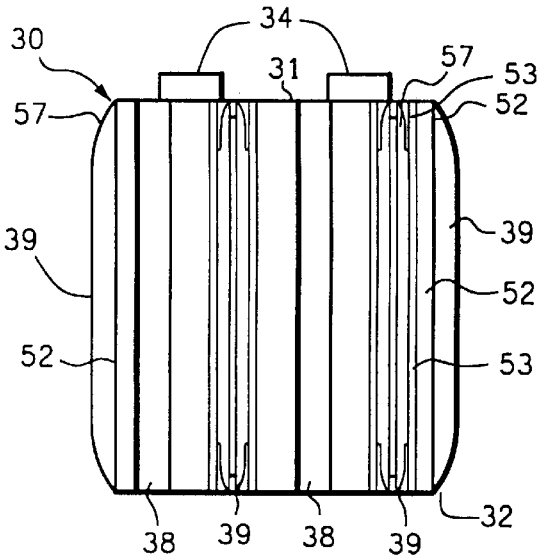
FIG. 5 is a side view of the building element of FIG. 3.
Figure 6:
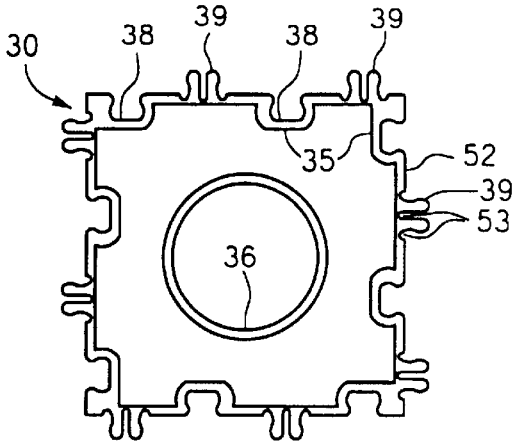
FIG. 6 is a bottom view of the building element of FIG. 3.

Referring to FIGS. 3 through 9, a preferred embodiment of a building element according to the present invention is a plastic box 30 including a top 31, a bottom 32 and a plurality of side walls 33. The top 31 of the box 30 includes a two-dimensional array of cylindrical projections 34 and the bottom 32 of the box 30 is open. The interior surfaces 35 of the box 30 and an interior tube 36 are accessible through the bottom of the box for interconnecting with one or more of the projections 34 on the top of another such building element in a releasable frictional engagement. Although the box 30 shown in the drawing has a relatively square lateral cross-section, the lateral cross-section of the box 30 may be longer in one dimension than another, and may be other than rectangular, such as circular, semi- or quarter-circular or triangular, for example. Also, the top of the box may include a different number and/or array of cylindrical projections 34 than shown in the drawing.

In an alternative embodiment (not shown), the building element includes only one groove 38 and one tongue 39 on each side wall 33 and one projection 34 on the top of the box. This building element is only one-quarter the breadth and one one-half the height of the building element shown in FIGS. 3 through 9. In this embodiment, the interior surfaces of the box that are accessible through the bottom of the box are shaped to enable the building element to be interconnected with a projection 34 on the top of another building element in a releasable frictional engagement. There is no tube within the box.

In another alternative embodiment (not shown), a building element of relatively the same size as shown in FIGS. 3 through 9 includes a single substantially larger cylindrical projection, as in the prior art building element shown in FIGS. 2A and 2B, and the bottom of the box is open, wherein the interior surfaces are accessible, as shown in FIG. 2B, for interconnecting with the projection on the top of another such building element in a releasable frictional engagement. According to this alternative embodiment, a building element of twice the length of the building element shown in FIGS. 3 through 9 has two such larger cylindrical projections.

In the preferred embodiment shown in FIGS. 3 through 9, each side 33 of the box 30 includes a plurality of grooves 38 and a plurality of tongues 39. Each of the grooves 38 has an entry opening of a given predominant width and each of the tongues 39 has a distal portion of a predominant width that is greater than the given predominant width of the groove entry opening for interconnecting in a releasable restraining engagement with a groove 38 in another such building element. Each tongue 39 is flexible and split longitudinally into sections so that the tongue 39 can be compressed laterally in order to effect such restraining engagement by frontally pressing the tongue 39 into the groove 38 in the other such building element. The compression of the tongue 39 also enables the tongue 39 to be disengaged from the groove 38 in the other such building element by frontally pulling the building element from the other said building element. Such compression of the tongue 39 also enables the tongue 39 to be disengaged from the groove 38 in the other building element by twisting the building element from the other building element. The tongue 39 can also be engaged with or disengaged from the groove 38 in the other such building element by sliding the tongue 39 into or from one end of the groove 38 in the other building element.

Figure 7:
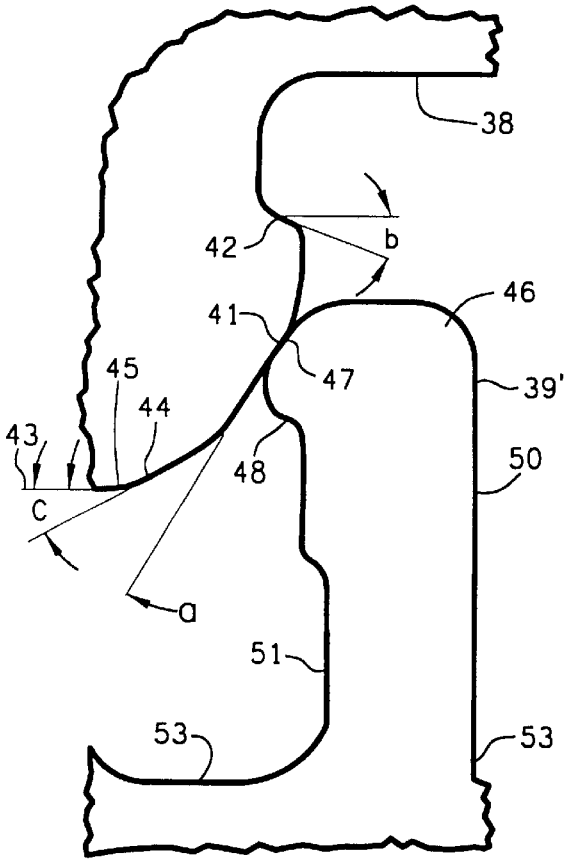
FIG. 7 is an enlarged partial top view illustrating the initial stage of an interconnection between two building elements of the embodiment shown in FIG. 3 when one side of a tongue that initially contacts one side of a groove, and further illustrating the lateral contour of one side of the tongue and one side of the groove.

Referring to FIG. 7, it is seen that adjacent the entry opening the groove is defined by a first portion 41 of the side wall that is inclined outward at an entry angle a and a second portion 42 of the side wall that is inclined inward at a restraining angle b that is less than the entry angle a in relation to a virtual broad surface 43 of the side wall so that less force is required to effect engagement by frontally pressing the tongue 39 into the groove 38 in the other such building element, as shown in FIG. 7, than is required to effect disengagement by frontally pulling the building element from the other building element.

The groove is further defined by a third portion 44 of the side wall that is closer to an outside edge 45 of the groove 38 than the first portion 41 of the side wall and is inclined outward at a locating angle c that is less than the entry angle a in relation to the virtual broad surface 43 of the side wall in order to help position the distal portion 46 of the tongue 39 at the entry opening of the groove 38.

Referring to FIG. 7, it is seen that a portion 47 of the tongue 39 that initially contacts the first portion 41 of the side wall when the tongue 39 is being frontally pressed into the groove 38 is inclined at approximately a complementary angle to the entry angle a.

Figure 8:
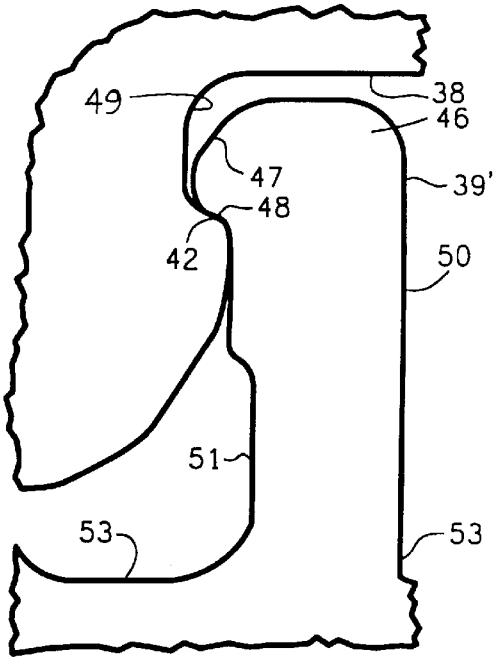
FIG. 8 is an enlarged partial top view illustrating the final stage of an interconnection between two building elements of the embodiment shown in FIG. 3 when the tongue is engaged within the groove.

Referring to FIG. 8, it is seen that a portion 48 of the tongue 39 that is adjacent the second portion 42 of the at least one side wall when the distal portion 46 of the tongue 39 is engaged within a base region 49 of the groove 38 is inclined at an angle that is quite small in relation to the overall breadth (or virtual broad surface 43) of the side wall. This angle may be within a range between a complementary angle to the restraining angle b and zero degrees in relation to the overall breadth of the side wall. The width of the base region 49 is greater than the given predominant width of the entry opening of the groove 38.

The split tongue 39 includes two parallel sections 39'. At least one, and preferably both of the tongue sections 39', has a cross-sectional profile, as shown in FIGS. 7 and 8, in which the distal portion 46 extends laterally to one edge of the uncompressed width of the tongue 39, an outwardly extended intermediate portion 50 extends laterally approximately to one side of the entry opening of the groove 38 when the tongue 39 is engaged in the groove 38, as shown in FIG. 8, and an outwardly extended base portion 51 is not as wide as the intermediate portion 50 in order to enhance the flexibility of the tongue section 39. In alternative embodiments (not shown), (i) the side of the base portion 51 facing the other tongue section is indented rather than the side of the base portion 51 shown in FIGS. 7 and 8; or (ii) neither side of the base portion 51 is indented but the respective lateral extensions of the base portion 51, the intermediate portion 50 and the distal portion 46 toward the other tongue section are reduced in order to provide the requisite flexibility for the split tongue section 39'.

Preferably, the edges and the ends of the tongues 39 are rounded so as to soften their feel to the fingers of a child when one building element is being interconnected with another such building block by frontally pressing the tongues 39 of the one building element into the grooves 38 of the other building element.

The side wall 33 has a primary surface 52 that includes recesses 53 adjacent the tongue sections 39' so that the tongue sections 39' extend outward from below the primary surface 52 and thereby need not extend as far outward in relation to the primary surface 52 of the side wall 33 as otherwise would be required to attain the degree of flexibility provided by a given length of outward extension from the base of the tongue section 39'. An alternative embodiment (not shown) does not include such recesses adjacent the tongue sections.

The grooves 38, the tongues 39 and the recesses 53 extend vertically. In one preferred embodiment, as shown in FIG. 9, the grooves 38, the tongues 39 and the recesses 53 extend vertically all the way to the top 31 and/or the bottom of the box 30, but the ends 57 of the tongues 39 do not extend outward in relation to a primary surface 52 of the side wall 33 as much as a predominant portion of the tongue 39 extends outward in relation to the primary surface 52 of the side wall 33 and the width of the ends 57 of the tongues is not greater than the given predominant width of the groove entry opening. This configuration facilitates initiation of interconnection of the building elements when sliding the tongues 39 into the ends of the grooves 38. Initiation of interconnection of the building elements effected by sliding the tongues 39 into the ends of the grooves 38 is also facilitated by the width of the ends 56 of the entry openings of the grooves 38 being greater than the given predominant width of the groove entry opening.

In an alternative referred embodiment, as shown in FIG. 10, the grooves 38 and the recesses 53 extend all the way to the top 31 and/or the bottom of the box 30, but the tongues 39 do not, and thereby provide a step 54 adjacent the top 31 and/or the bottom of the box 30 that facilitates positioning the side wall 33 of one building element closer to the side wall 33 of another building element when initiating interconnection of the building elements by sliding the tongues 39 into the ends of the grooves 38. Also, the width of the ends 59 of the tongues 39 is not greater than the given predominant width of the groove entry opening, as also shown in FIG. 9. In other respects, the alternative preferred embodiment of FIG. 10 may include the same features as described above with reference to FIGS. 3 through 9.

In an alternative embodiment of the building element according to the present invention, as partially shown in FIG. 11, the grooves 38 are defined by portions 61 of the side wall that are flexible so that the entry openings of the grooves 38 can be expanded laterally in order to ease engagement when the tongues 39 are frontally pressed into the grooves 38. The side wall has a primary surface 52 that includes recesses 63 adjacent the portions 61 of the side wall that define the grooves 38 so that the grooves 38 extend below the primary surface 52 and thereby need not extend as far outward in relation to the primary surface 52 as otherwise would be required to attain the degree of flexibility provided by a given length of outward extension from the base of the flexible groove-defining portion 61 of the side wall. An alternative embodiment (not shown) does not include such recesses 63 adjacent the flexible groove-defining portion of the side wall. In other respects, the alternative preferred embodiment of FIG. 11 may include the same features as described above with reference to FIGS. 3 through 10.

In alternative embodiments (not shown), the extension of the tongues and grooves need not be vertical, and projections other than tongues can be pressed into sockets other than grooves to effect a releasable restraining engagement between the side walls of the building elements in accordance with the present invention.

Referring to FIG. 12, it is seen that the respective dispositions of the plurality of tongues 39 and the plurality of grooves 38 on and in the sides walls 33 are such that one side wall 33 of one building element can be interconnected to a side wall 33 of each of two other building elements with at least two tongue-and-groove engagements between each pair of the interconnected building elements to thereby enhance the interconnections between each pair of such interconnected building elements.

The advantages specifically stated herein do not necessarily apply to every conceivable embodiment of the present invention. Further, such stated advantages of the present invention are only examples and should not be construed as the only advantages of the present invention. While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

I claim:

1. A building element for a set of toy building elements that are capable of being interconnected in a releasable engagement, comprising a top, a bottom and side walls;

wherein at least one of the side walls includes at least one groove having an entry opening of a given predominant width and a base region of a greater width;

wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove;

wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into the said groove in the other said building element and in order to disengage the tongue from the said groove in the other said building element by frontally pulling the building element from the other said building element;

wherein adjacent the entry opening the groove is defined by a portion of the at least one side wall that is inclined inward at a restraining angle to define the base region of the groove; and wherein a portion of the tongue that initially contacts the portion of the at least one side wall at the entry opening, when the tongue is being frontally pressed into the said groove in the other said building element, is inclined outward at approximately a first angle; and wherein a portion of the tongue that is adjacent the inwardly inclined portion of the at least one side wall, when the distal portion of the tongue is engaged within the base region of the said groove in the other said building element, is inclined inward at a second angle that is less than the first angle in relation to a virtual broad surface of the at least one side wall.

2. A building element according to claim 1, wherein the second angle is sufficiently less than the first angle that substantially less force is required to effect said restraining engagement by frontally pressing the tongue into the said groove in the other said building element than is required to effect said disengagement by frontally pulling the building element from the other said building element.

3. A building element according to claim 1, wherein adjacent the entry opening the groove is defined by a first portion of the at least one side wall that is inclined outward at an entry angle and a second portion of the at least one side wall that is inclined inward at a restraining angle that is less than the entry angle in relation to a virtual broad surface of the at least one side wall; and wherein the restraining angle is sufficiently less than the entry angle that substantially less force is required to effect said restraining engagement by frontally pressing the tongue into a said groove in the other said building element than is required to effect said disengagement by frontally pulling the building element from the other said building element.

4. A building element according to claim 1, wherein adjacent the entry opening the groove is defined by a first portion of the at least one side wall that is inclined outward at an entry angle and a second portion of the at least one side wall that is inclined inward at a restraining angle that is less than the entry angle in relation to a virtual broad surface of the at least one side wall; and wherein the restraining angle is sufficiently less than the entry angle and the second angle is sufficiently less than the first angle that substantially less force is required to effect said restraining engagement by frontally pressing the tongue into a said groove in the other said building element than is required to effect said disengagement by frontally pulling the building element from the other said building element.

5. A building element for a set of toy building elements that are capable of being interconnected in a releasable engagement, comprising a top, a bottom and side walls;

wherein at least one of the side walls includes at least one groove having an entry opening of a given predominant width and a base region of a greater width;

wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove;

wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into the said groove in the other said building element and in order to disengage the tongue from the said groove in the other said building element by frontally pulling the building element from the other said building element; and wherein adjacent the entry opening the groove is defined by a first portion of the at least one side wall that is inclined outward at an entry angle and a second portion of the at least one side wall that is inclined inward at a restraining angle that is less than the entry angle in relation to a virtual broad surface of the at least one side wall.

6. A building element according to claim 1, wherein the restraining angle is sufficiently less than the entry angle that substantially less force is required to effect said restraining engagement by frontally pressing the tongue into the said groove in the other said building element than is required to effect said disengagement by frontally pulling the building element from the other said building element.

7. A building element according to claim 5, wherein the groove is further defined by a third portion of the at least one side wall that is closer to an outside edge of the groove than the first portion of the at least one side wall and is inclined outward at a locating angle that is less than the entry angle in relation to the virtual broad surface of the at least one side wall.

8. A building element according to claim 5, wherein a portion of the tongue that initially contacts the first portion of the at least one side wall when the tongue is being frontally pressed into the said groove in the other said building element is inclined at approximately a complementary angle to the entry angle.

9. A building element according to claim 5, wherein a portion of the tongue that is adjacent the second portion of the at least one side wall when the tongue is engaged within the said groove in the other said building element is inclined at an angle that is in a range between a complementary angle to the restraining angle and zero degrees in relation to the overall breadth of the at least one side wall.

10. A building element for a set of toy building elements that are capable of being interconnected in a releasable engagement, comprising a top, a bottom and side walls;

wherein at least one of the side walls includes at least one groove having an entry opening of a given predominant width and a base region of a greater width;

wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove;

wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into the said groove in the other said building element and in order to disengage the tongue from the said groove in the other said building element by frontally pulling the building element from the other said building element;

wherein the at least one side wall including the tongue has a primary surface that includes recesses adjacent the tongue sections so that the tongue sections extend outward from below the primary surface.

11. A building element for a set of toy building elements that are capable of being interconnected in a releasable engagement, comprising a top, a bottom and side walls;

wherein at least one of the side walls includes at least one groove having an entry opening of a given predominant width and a base region of a greater width;

wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove;

wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into the said groove in the other said building element and in order to disengage the tongue from the said groove in the other said building element by frontally pulling the building element from the other said building element;

wherein the split tongue includes two parallel sections, at least one of which has a cross-sectional profile in which the distal portion extends laterally to one edge of the uncompressed width of the tongue, an outwardly extended intermediate portion extends laterally approximately to one side of the entry opening of the said groove when the tongue is engaged in the said groove, and an outwardly extended base portion, wherein the base portion of the tongue is not as wide as the intermediate portion in order to enhance the flexibility of the one tongue section.

12. A building element according to claim 11, wherein the at least one side wall including the tongue has a primary surface that includes recesses adjacent the tongue sections so that the tongue sections extend outward from below the primary surface.

* * * * *